United States Patent [19]

Uzrad

[11] Patent Number: 4,512,519

[45] Date of Patent: Apr. 23, 1985

[54] SPRINKLER

[75] Inventor: Mordechay Uzrad, Hof Hacarmel, Israel

[73] Assignee: Mifalei Matechet Naan, Kibbutz Naan, Israel

[21] Appl. No.: 432,861

[22] Filed: Oct. 5, 1982

[51] Int. Cl.[3] ..... B05B 3/16

[52] U.S. Cl. ..... 239/381; 239/DIG. 1

[58] Field of Search ..... 239/222.17, 222.19, 239/222.21, 498, 504, 505, 513, 380, 381, 382, DIG. 1

[56] References Cited

U.S. PATENT DOCUMENTS

| | | | |
|---|---|---|---|
| 461,415 | 10/1891 | Bonnette | 239/222.21 |
| 581,252 | 4/1897 | Quayle | 239/222.21 X |
| 2,758,013 | 3/1957 | Stearns | 239/498 X |
| 3,532,273 | 10/1970 | Sidall et al. | 239/222.17 |
| 4,331,294 | 5/1982 | Gilad | 239/222.17 |

FOREIGN PATENT DOCUMENTS

| | | | |
|---|---|---|---|
| 37210 | 4/1923 | Norway | 239/222.21 |

*Primary Examiner*—Jeffrey V. Nase
*Assistant Examiner*—Michael J. Forman
*Attorney, Agent, or Firm*—Browdy and Neimark

[57] ABSTRACT

A sprinkler comprising a water conduit which is connectable to a water feed line and supplies water to a nozzle, a rotatable body, revolving about a vertical axis being positioned above, and concentrically with the nozzle, a central bore being provided in the body and downwardly open curved slots extending from the central bore, seating apparatus for the rotatable body placing it in concentric position to the nozzle, and apparatus for changing the relative position of nozzle and rotating body to be eccentric.

4 Claims, 8 Drawing Figures

FIG. 1
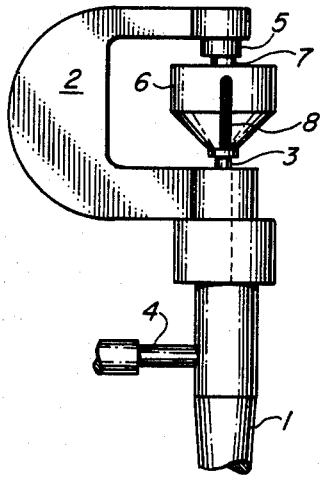
FIG. 3
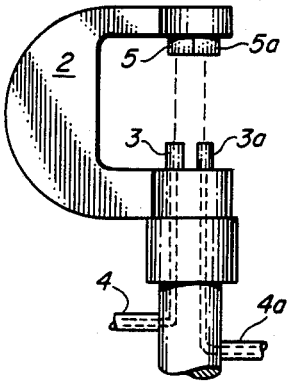
FIG. 2
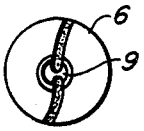
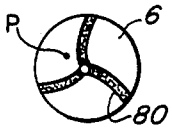
FIG. 4
FIG. 5
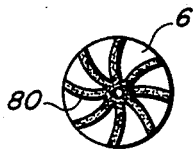
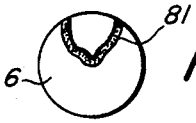
FIG. 6
FIG. 7
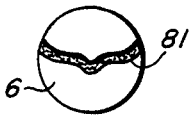
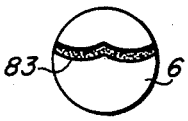
FIG. 8

SPRINKLER

BACKGROUND OF INVENTION

The present invention relates to a sprinkler and more particularly a type which is known in the trade as "mini-sprinkler" and to which will be referred to in the following description under that designation. Such sprinklers are used in agriculture and horticulture in those cases where it is necessary to irrigate single plants or small areas of ground. A sprinkler of this type is shown in FIG. 1 of the accompanying drawings: On an upright 1 which may be stuck in the ground or affixed to whatever supporting structure is held a C shaped bracket 2. This bracket on its lower horizontal arm carries a nozzle 3 to which water can be supplied through a conduit 4. On the upper horizontal arm of member 2 is provided a downwardly directed hollow stub 5 which constitutes a seat for a revolvable body 6 which is held by its stem 7 in the said stub 5. The member 6 has a downwardly directed conical face which is provided with two curved slots 8 which extend from a central bore 9 (see FIG. 2 which shows the underside of body 6) to the outer periphery of body 6.

This mini-sprinkler functions in the following way: Water gushes from the nozzle 3, enters the central bore 9 which communicates with the slots 8 from which the water leaves as a spray. In view of the fact that the slots 8 are curved the body 2 is rotated by reaction of the water jets leaving the slots 8.

OBJECT AND FIELD OF INVENTION

It is an object of the present invention to make use of the mini-sprinkler just described for additional purposes of irrigation. While the described mini-sprinkler according to FIGS. 1 and 2 cover a small circular area it is desirable in certain cases to direct the spray to one side of the sprinkler i.e. to irrigate not a full circle area but only a sector thereof. This might be necessary where a single plant or bush is to be provided with irrigation and water should not be wasted by directing it to areas which do not require it.

SHORT SUMMARY OF DISCLOSURE

There is provided a sprinkler comprising a water conduit which is connectable to a water feed line and supplies water to a nozzle, a rotatable body revolving about a vertical axis being positioned above, and concentrically with the said nozzle, a central bore being provided in said body and downwardly open curved slots extending from said central bore, characterised thereby that in addition to the seat of the rotatable body placing it in concentric position to the nozzle, means are provided to change the relative position of nozzle and rotating body to be eccentric.

These and further features of the invention will become clear from the following detailed description.

SHORT DESCRIPTION OF DRAWINGS

The following description refers to the annexed drawings wherein

FIG. 1 illustrates a prior art sprinkler device;

FIG. 2 illustrates the arrangement of delivering slots in the sprinkler of FIG. 1;

FIG. 3 illustrates the new improved sprinkler while

FIGS. 4 to 8 show several examples of the arrangement of the delivering slots at the underside of the rotatable body.

DETAILED DESCRIPTION OF PREFERRED EMBODIMENT

Turning now to FIG. 3, it is remarked that the parts that are identical with those in FIG. 1 are indicated by the same numerals and therefore need no further description. In addition to the stub 5 which—as has been explained—serves to hold the rotatable body 6, there is provided a second like stub 5*a* which is placed close to the stub 5. The rotatable body 6 can be removed from its seat in stub 5 and can be placed in stub 5*a*. As a consequence the water gushing from nozzle 3 may no longer meet the body 6 at its center. This is exemplified by FIG. 4. Here it can be seen that a point marked P water is supposed to impinge on the underside of the body 6. Thus water does no longer enter the central bore of the body 6 but instead strikes point P. As can be seen in FIG. 4 the body 6 is provided with three grooves 80 which extend from the center of the body 6. The jet of water gushing upwardly from nozzle 3, when meeting one of the slots 80 will obviously leave at the outer end thereof. Now since the slots are curved as has already been described the body 6 will be put into rotation. But in view of the fact that water enters the slots only when these cross the water jet water will be ejected from the slots only to one direction of the sprinkler, and will water an area which is equal to substantially one third of a circle i.e. a sector of roughly 120°. The curvature of the slots 80 is identical for which reason the rotation of body 6 is uni-directional. As can be seen in FIG. 3 there are two stubs—5 and 5*a* and two nozzles—3 and 3*a*. Each nozzle can be connected to the water supply independently from the other; conduits 4 and 4*a* lead to the two nozzles. Thus in order to have the desired effect referred to above, it is possible to shift the rotating body 6 (not shown in FIG. 3) from stub 5 to stub 5*a*. Alternatively it can be left in stub 5 but nozzle 3*a* is connected to the water supply: In both cases the water jet impinges eccentrically on body 6.

According to FIG. 5 there is provided a greater number of slots 80, namely seven. Water again impinges on body 6 at a point which is eccentric in relation to the center of body 6 and therefore water enters again as has been explained in connection with FIG. 4, one of the slots 80 whenever the latter crosses the water jet. In this case the sector covered by the spray will be one-seventh of the circle.

The arrangement of FIGS. 6, 7 and 8 differs from the one described till now insofar as the slots indicated by the numeral 81 in FIG. 6 are no longer uni-directionally curved but oppositely one another. Again the jet of water leaving the nozzle 3 is supposed to impinge on a point which is eccentrically placed on the underside of body 6 and again the spray enters one of the slots 81 whenever the latter crosses the jet. However since the two slots 81 are oppositely curved the body 6 will be caused to revolve into one direction and that direction will be reversed when the water enters the second slot. This is obvious since the reaction of the water leaving the slots 81 is acting to opposed directions. Accordingly the body 6 will move or oscillate to and fro. An arrangement according to FIG. 6 does irrigate sector shaped areas, but in this case not one sector shaped area but two distinct sector shaped areas.

According to FIG. 7 the same effect is achieved, but the sectors are of a wider shape. Finally in FIG. 8 two slots 83 are oppositely curved and extend to opposite sides, the effect of this arrangement being that two sectors are watered which are not juxtaposed but on different sides of the sprinkler.

It would be within the scope of the invention to bring about the change of relative position of the revolving body and nozzle by displacing the latter. This can be done by having the nozzle attached releasably to the support and directly connected to a flexible feed conduit.

I claim:

1. A sprinkler comprising:

a water conduit which is connectable to a water feed line and supplies water to a nozzle, a rotatable body, revolving about a vertical axis, being positioned above and concentrically with the said nozzle, a central bore being provided in said body and downwardly open curved slots being defined in said body extending from said central bore, at least two of said slots defining oppositely curved arcs arranged to provide a water spray in two different directions, seating means for the rotatable body adapted for placing the rotatable body in concentric position to the nozzle, and means for changing the relative position of nozzle and rotating body from being relatively concentric to eccentric, so that a water jet impinges eccentrically on the said body.

2. A sprinkler according to claim 1 and wherein said means for changing comprises a second seat for the rotating body, placing said rotating body eccentric relative to the nozzle.

3. A sprinkler, as claimed in claim 1, and wherein said means for changing comprises a second nozzle beside the normal concentric position relative to the rotating body, this second nozzle being independently couplable to a water source and mounted eccentrically relative to the rotating body.

4. A sprinkler comprising:

a water conduit which is connectable to a water feed line and supplies water to a nozzle;

a rotatable body, revolving about a vertical axis, being positioned above and eccentrically relative to said nozzle;

the rotatable body defining a central bore and two downwardly open curved slots extending from said central bore;

said slots defining oppositely curved arcs about the rotatable body;

means for seating the rotatable body in eccentric relation to the nozzle whereby said rotatable body oscillates back and forth when a water jet impinges eccentrically thereon.

* * * * *